US009396734B2

(12) United States Patent
Mittal et al.

(10) Patent No.: US 9,396,734 B2
(45) Date of Patent: Jul. 19, 2016

(54) CONVERSION OF LINEAR PREDICTIVE COEFFICIENTS USING AUTO-REGRESSIVE EXTENSION OF CORRELATION COEFFICIENTS IN SUB-BAND AUDIO CODECS

(71) Applicant: MOTOROLA MOBILITY LLC, Libertyville, IL (US)

(72) Inventors: Udar Mittal, Hoffman Estates, IL (US); James P. Ashley, Naperville, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 145 days.

(21) Appl. No.: 14/200,192

(22) Filed: Mar. 7, 2014

(65) Prior Publication Data

US 2014/0257798 A1 Sep. 11, 2014

Related U.S. Application Data

(60) Provisional application No. 61/774,777, filed on Mar. 8, 2013.

(51) Int. Cl.
*G10L 19/06* (2013.01)
*G10L 19/02* (2013.01)

(52) U.S. Cl.
CPC ..... *G10L 19/06* (2013.01); *G10L 19/0208* (2013.01)

(58) Field of Classification Search
CPC ..... G10L 19/06; G10L 19/07; G10L 19/0208
See application file for complete search history.

(56) References Cited

U.S. PATENT DOCUMENTS

| | | | | |
|---|---|---|---|---|
| 6,691,082 | B1 * | 2/2004 | Aguilar | G10L 19/0208 704/219 |
| 7,260,523 | B2 * | 8/2007 | Paksoy | G10L 21/038 704/220 |
| 2003/0050775 | A1 * | 3/2003 | Zinser, Jr. | G10L 19/00 704/219 |
| 2003/0135365 | A1 * | 7/2003 | Thyssen | G10L 19/06 704/228 |
| 2007/0094018 | A1 * | 4/2007 | Zinser, Jr. | G10L 19/173 704/219 |
| 2007/0271092 | A1 | 11/2007 | Ehara et al. | |
| 2013/0144614 | A1 * | 6/2013 | Myllyla | G10L 19/0208 704/210 |

OTHER PUBLICATIONS

The International Search Report and Written Opinion of the International Searching Authority (PCT/ISA/220, PCT/ISA/210 and PCT/ISA/237) for Application No. PCT/US2014/021591, dated Jun. 24, 2014.

Binshi Cao: "Subband synthesized LPC Vector quantization (SBS-LPC-VQ)", Speech Coding, 2000, Proceedings . 2000 IEEE Workshop on , Sep. 17, 2000, all pages.

* cited by examiner

*Primary Examiner* — Douglas Godbold
(74) *Attorney, Agent, or Firm* — Birch, Stewart, Kolasch & Birch, LLP

(57) ABSTRACT

Disclosed are systems and methods for the efficient conversion of linear predictive coefficients. This method is usable, for example, in the conversion of full band linear predictive coding ("LPC") coefficients to sub-band LPCs of a sub-band speech codec. The sub-bands may or may not be down-sampled. In an embodiment, the LPC coefficients of the sub-bands are obtained from the correlation coefficients, which are in turn obtained by filtering the auto-regressive extended auto-correlation coefficients of the full band LPCs. The method also allows the generation of an LPC approximation of a pole-zero weighted synthesis filter.

19 Claims, 8 Drawing Sheets

| FIG. 7A |
| --- |
| FIG. 7B |

CONVERSION OF LINEAR PREDICTIVE COEFFICIENTS USING AUTO-REGRESSIVE EXTENSION OF CORRELATION COEFFICIENTS IN SUB-BAND AUDIO CODECS

CROSS-REFERENCE TO RELATED APPLICATION

The present application claims priority to U.S. Provisional Patent Application 61/774,777, filed on Mar. 8, 2013, which is incorporated herein by reference in its entirety.

TECHNICAL FIELD

The present disclosure is related generally to audio encoding and decoding and, more particularly, to a system and method for conversion of linear predictive coding ("LPC") coefficients using the auto-regressive ("AR") extension of correlation coefficients for use in sub-band speech or other audio encoder-decoders ("codecs").

BACKGROUND

Many devices used for communication or entertainment purposes possess the ability to play back or reproduce sound based on a signal representing that sound. For example, a personal computer, laptop computer, or tablet computer may be used to play a video that has both image and sound. A smart-phone may be able to play such a video and may also be used for voice communications, i.e., by sending and receiving signals that represent a human voice.

In all such systems, there is a need to electrically encode the sound signal for transmission or storage and conversely to electrically decode the encoded signal upon receipt. Early forms of sound encoding included encoding sound as bumps in plastic or wax (e.g., early gramophones and record players), while later forms of analog encoding became more symbolic, recording sound as magnetic magnitudes on discrete regions of a magnetic tape. Digital recording, coming later still, converted the sound signal to a series of numbers and provided for more efficient usage of transmission and storage facilities.

However, as the transmission of sound data became more prevalent and the computing power of the devices involved became increasingly greater, more complex and efficient systems for encoding were devised. For example, many cell-phone conversations today are encoded for transmission by way of a class of LPC algorithms. Algorithms in this class such as algebraic codebook linear predictive algorithms decompose speech, for example, into a model and an excitation for that model, mimicking the manner in which the human vocal tract (akin to the model) is excited by vibration of the vocal chords (akin to the excitation). The LPC coefficients describe the model.

While algorithms of this class are efficient with respect to bandwidth consumption, the process required to create the transmitted data is quite complex and computationally expensive. Moreover, the continued increase in consumer demands upon their computing devices raises a need for yet a further increase in computational efficiency. The present disclosure is directed to a system and method that may provide enhanced computational efficiency in audio coding and decoding. However, it should be appreciated that any particular benefit is not a limitation on the scope of the disclosed principles or of the attached claims, except to the extent expressly recited in the claims. Additionally, the discussion of technology in this Background section is merely reflective of inventor observations or considerations and is not an indication that the discussed technology represents actual prior art.

BRIEF DESCRIPTION OF THE SEVERAL VIEWS OF THE DRAWINGS

While the appended claims set forth the features of the present techniques with particularity, these techniques, together with their objects and advantages, may be best understood from the following detailed description taken in conjunction with the accompanying drawings of which:

DETAILED DESCRIPTION

Before providing a detailed discussion of the figures, a brief overview is given to guide the reader. The disclosed systems and methods provide for the efficient conversion of linear predictive coefficients. This method is usable, for example, in the conversion of full band LPC to sub-band LPCs of a sub-band speech codec. The sub-bands may or may not be down-sampled. In this method, the LPC of the sub-bands are obtained from the correlation coefficients which are in turn obtained by filtering the AR extended auto-correlation coefficients of the full band LPCs. The method then allows the generation of an LPC approximation of a pole-zero weighted synthesis filter. While one may attempt to employ FFT-based methods to strive for the same general result, such methods tend to be much less suitable in terms of both complexity and accuracy.

Turning now to a more detailed discussion in conjunction with the attached figures, techniques of the present disclosure are illustrated as being implemented in a suitable environment. The following description is based on embodiments of the disclosed principles and should not be taken as limiting the claims with regard to alternative embodiments that are not explicitly described herein. Thus, for example, while FIG. 1 illustrates an example mobile device within which embodiments of the disclosed principles may be implemented, it will be appreciated that many other devices such as, but not limited to laptop computers, tablet computers, personal computers, embedded automobile computing systems and so on may also be used.

Figure 1:
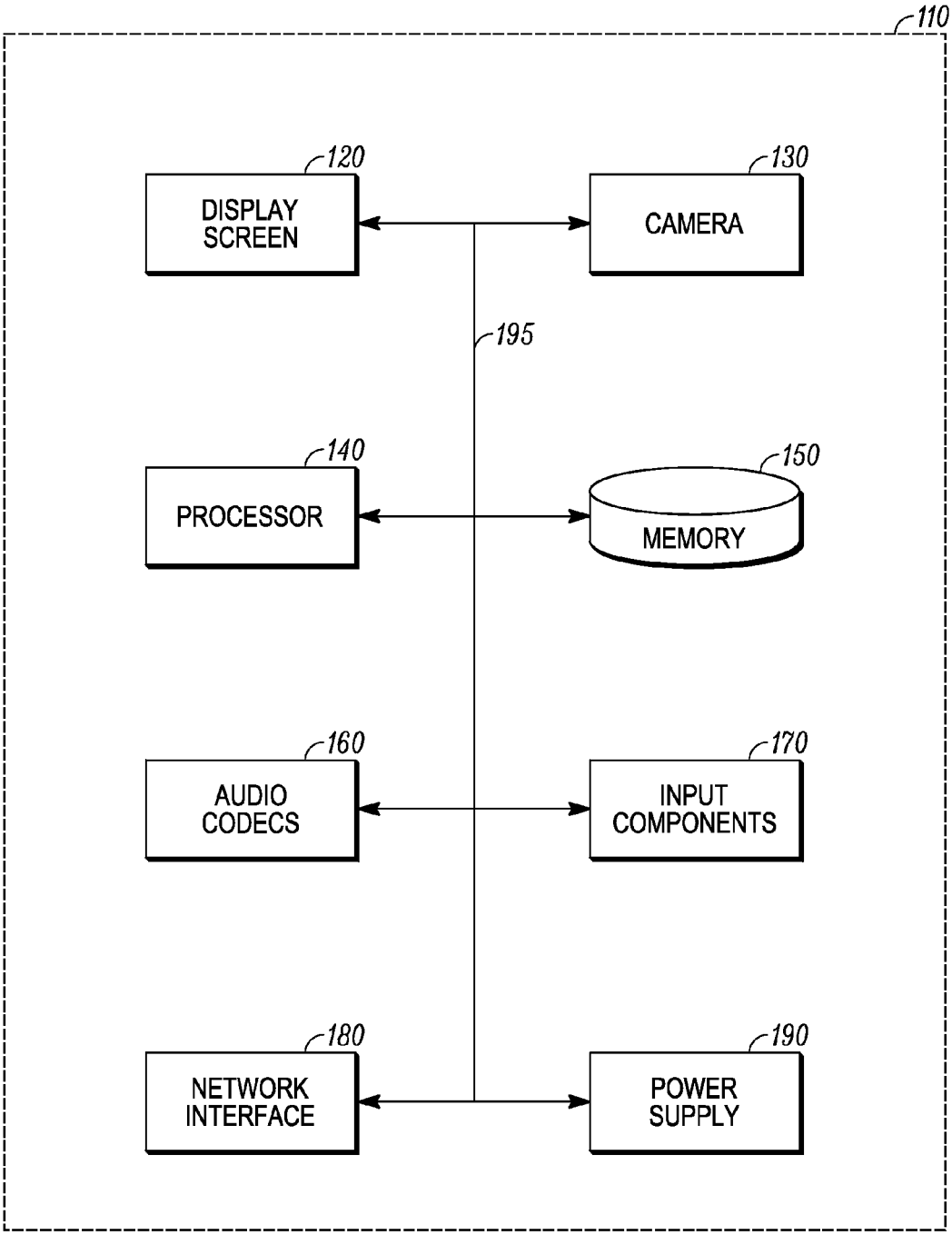
FIG. 1 is a schematic diagram of an example device within which embodiments of the disclosed principles may be implemented.

The schematic diagram of FIG. 1 shows an exemplary device forming part of an environment within which aspects of the present disclosure may be implemented. In particular, the schematic diagram illustrates a user device 110 including several exemplary components. It will be appreciated that additional or alternative components may be used in a given implementation depending upon user preference, cost, and other considerations.

In the illustrated embodiment, the components of the user device 110 include a display screen 120, a camera 130, a processor 140, a memory 150, one or more audio codecs 160, and one or more input components 170.

The processor 140 can be any of a microprocessor, microcomputer, application-specific integrated circuit, or the like. For example, the processor 140 can be implemented by one or more microprocessors or controllers from any desired family or manufacturer. Similarly, the memory 150 may reside on the same integrated circuit as the processor 140. Additionally or alternatively, the memory 150 may be accessed via a network, e.g., via cloud-based storage. The memory 150 may include a random-access memory (i.e., Synchronous Dynamic Random-Access Memory, Dynamic Random-Access Memory, RAMBUS Dynamic Random-Access Memory, or any other type of random-access memory device). Additionally or alternatively, the memory 150 may include a read-only memory (i.e., a hard drive, flash memory or any other desired type of memory device).

The information that is stored by the memory 150 can include program code associated with one or more operating systems or applications as well as informational data, e.g., program parameters, process data, etc. The operating system and applications are typically implemented via executable instructions stored in a non-transitory computer readable medium (e.g., memory 150) to control basic functions of the electronic device 110. Such functions may include, for example, interaction among various internal components and storage and retrieval of applications and data to and from the memory 150.

The illustrated device 110 also includes a network interface module 180 to provide wireless communications from and to the device 110. The network interface module 180 may include multiple communications interfaces, e.g., for cellular, WiFi, broadband, and other communications. A power supply 190, such as a battery, is included for providing power to the device 110 and to its components. In an embodiment, all or some of the internal components communicate with one another by way of one or more shared or dedicated internal communication links 195, such as an internal bus.

Further with respect to the applications, these typically utilize the operating system to provide more specific functionality, such as file-system service and handling of protected and unprotected data stored in the memory 150. Although many applications may govern standard or required functionality of the user device 110, in many cases applications govern optional or specialized functionality, which can be provided, in some cases, by third-party vendors unrelated to the device manufacturer.

Finally, with respect to informational data, e.g., program parameters and process data, this non-executable information can be referenced, manipulated, or written by the operating system or an application. Such informational data can include, for example, data that are preprogrammed into the device during manufacture, data that are created by the device, or any of a variety of types of information that is uploaded to, downloaded from, or otherwise accessed at servers or other devices with which the device 110 is in communication during its ongoing operation.

In an embodiment, the device 110 is programmed such that the processor 140 and memory 150 interact with the other components of the device 110 to perform a variety of functions. The processor 140 may include or implement various modules and execute programs for initiating different activities such as launching an application, transferring data, and toggling through various graphical user interface objects (e.g., toggling through various icons that are linked to executable applications).

Figure 2:
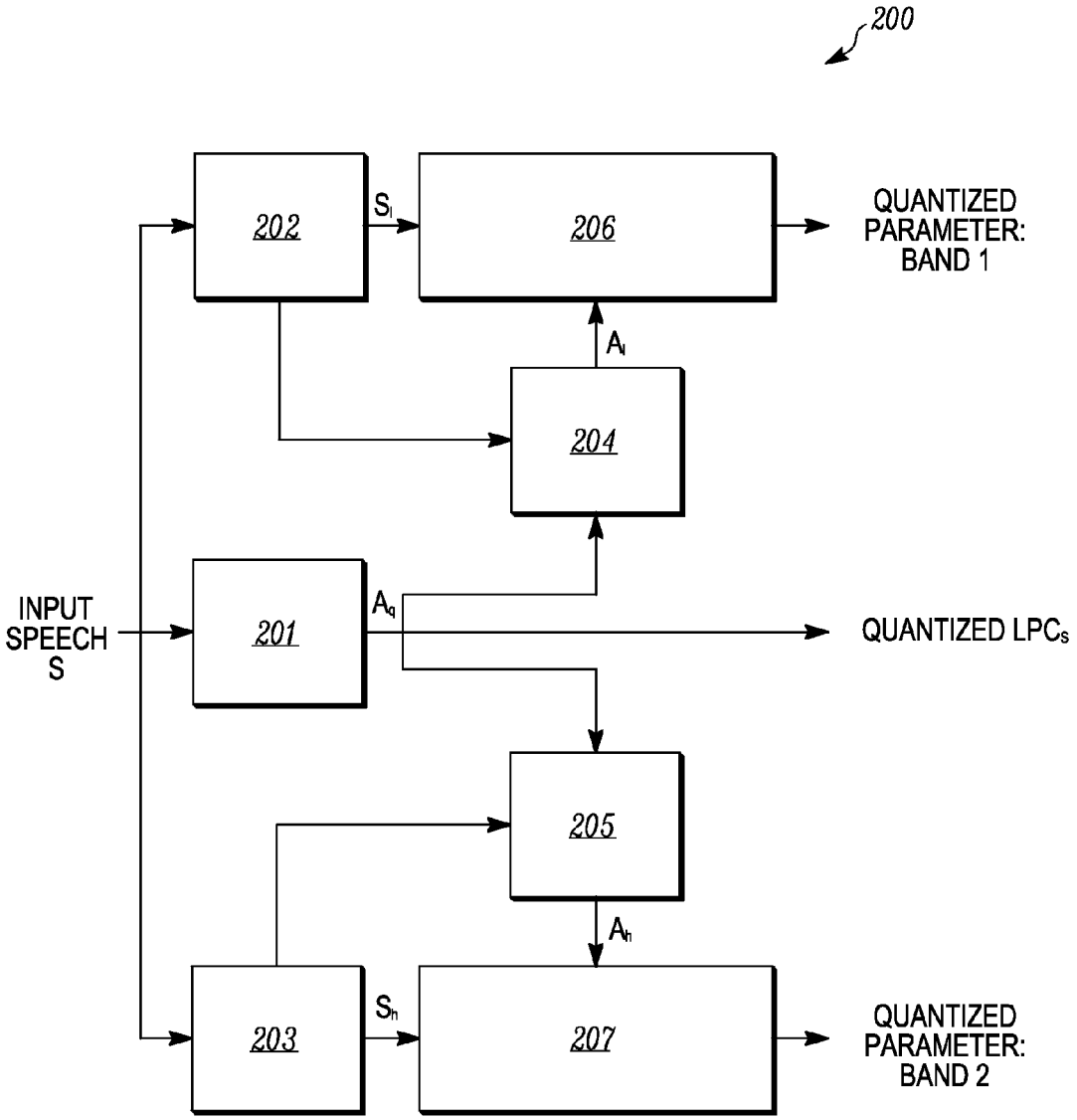
FIG. 2 is a schematic illustration of a sub-band speech coding architecture in accordance with embodiments of the disclosed principles.
Figure 3:
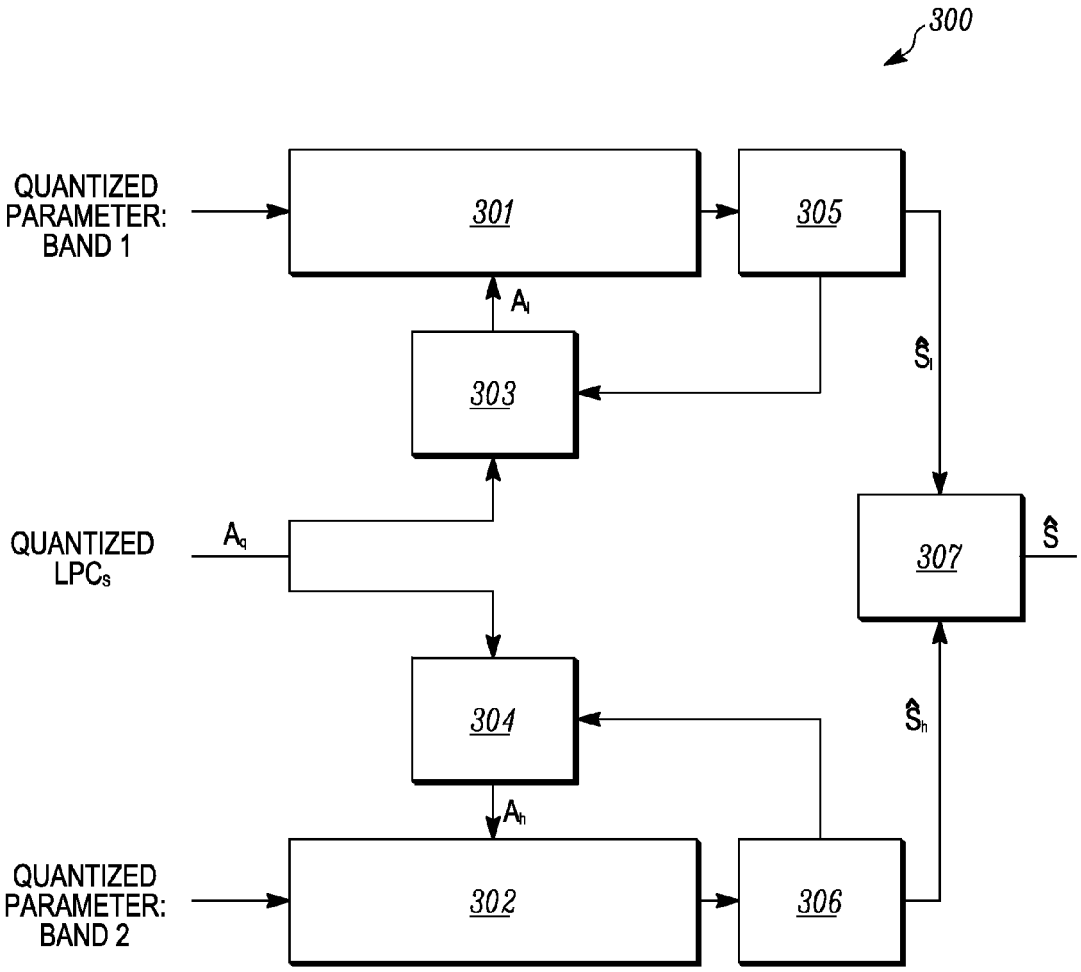
FIG. 3 is a schematic illustration of a sub-band speech decoding architecture in accordance with embodiments of the disclosed principles.

Although the device 110 described in reference to FIG. 1 may be used to implement the codec functions described herein, it will be appreciated that other similar or dissimilar devices may also be used. As noted above, the illustrated device 110 includes an audio codec module 160. This may include a sub-band speech encoder and decoder such as are shown in FIGS. 2 and 3 respectively. The illustrated speech coder 200 and decoder 300 each operate on two bands. The two bands may be a low frequency band (Band 1) and a high frequency band (Band 2) for example.

The encoder 200 receives input speech s at an LPC analysis filter 201 as well as at a first sub-band filter 202 and at a second sub-band filter 203. The LPC analysis filter 201 processes the input speech s to produce quantized LPC coefficients $A_q$. Because the quantized LPCs are common to both the bands, and the codec for each band requires an estimate of the spectrum of each of the respective bands, the quantized LPC coefficients $A_q$ are provided as input to a first LPC and correlation conversion module 204 associated with the first sub-band and to a second LPC and correlation conversion module 205 associated with the second sub-band.

The first and second LPC and correlation conversion modules 204, 205 provide band-specific LPC coefficients $A_l$ (low) and $A_h$ (high) to respective sub-band encoder modules 206, 207. The sub-band encoder modules 206, 207 receive respective filtered speech inputs $S_l$ (low) and $S_h$ (high) from the first sub-band filter 202 and the second sub-band filter 203. The sub-band encoder modules 206, 207 produce respective quantized LPC parameters for the associated bands. As such, the output of the encoder 200 comprises the quantized LPC coefficients $A_q$ as well as quantized parameters corresponding to each sub-band.

As will be appreciated, quantization of a value entails setting that value to a closest allowed increment. In the illustrated arrangement, the quantized LPC coefficients are shown as the only common parameter. However, it will be appreciated that there may be other common parameters as well, e.g., pitch, residual energy, etc.

The band spectra may be represented in any suitable form known in the art. For example a band spectrum may be represented as direct LPCs, correlation or reflection coefficients, log area ratios, line spectrum parameters or frequencies, or a frequency-domain representation of the band spectrum. It will be appreciated that the LPC conversion is dependent on the form of the filter coefficients of the sub-band filters.

The decoder 300 is similar to but essentially inverted from the encoder 200. The decoder 300 receives the quantized LPC coefficients $A_q$ as well as the quantized parameters corresponding to each sub-band. The quantized parameters corresponding to the low and high sub-bands are input to a respective first sub-band decoder 301 and a second sub-band decoder 302. The quantized LPC coefficients $A_q$ are provided to a first LPC and correlation conversion module 303 associated with the first sub-band and to a second LPC and correlation conversion module 304 associated with the second sub-band.

The first LPC and correlation conversion module 303 and the second LPC and correlation conversion module 304 output, respectively, the band-specific LPC coefficients $A_l$ (low) and $A_h$ (high), which are in turn provided to the first sub-band decoder 301 and to the second sub-band decoder 302. The outputs of the first sub-band decoder 301 and the second sub-band decoder 302 are provided to respective sub-band filters 305, 306, which produce, respectively, a low-band speech signal $s_l$ and a high-band speech signal $s_h$. The low-band speech signal $s_l$ and the high-band speech signal $s_h$ are combined in combiner 307 to yield a final recreated speech signal.

As noted above, one might use a frequency-domain approach for the LPC conversion. In this approach, the full band LPC is converted to the frequency domain using the FFT. The Fourier spectrum of the full band LPC is then multiplied by the power spectrum of the filter coefficients to obtain the power spectrum of the baseband signal. The LPC of the baseband signal is then computed using the inverse FFT of the power spectrum.

However, the accuracy of this frequency-domain approach is dependent on the length (N) of the FFT; the greater the FFT length, the better the estimation accuracy. Unfortunately, as the FFT length increases, complexity also increases. Moreover, since the LPC coefficients are representative of an AR process with an infinite impulse response ("IIR"), it may be inferred that irrespective of the FFT length, the frequency-domain approach will not result in the exact values of the correlation coefficients of the baseband signal. Intuitively an IIR signal, which must be truncated and windowed for FFT processing, will result in response inaccuracies regardless of the order of the FFT.

In contrast, the described system and method provide a low complexity, high accuracy estimate of the correlation coefficients, from which an LPC of the filtered signal may be derived. In an LPC-based speech codec, speech is assumed to correspond to an AR process of certain order n (typically n=10 for 4 kHz bandwidth, n=16 or 18 for 7 kHz bandwidth). For an AR signal s(j) with order n, the correlation coefficients R(k), k>n, can be obtained from the values of R(k) for $0 \le k \le n$ using the following recursive equation:

$$R(-k) = R(k) = \sum_{i=1}^{n} a_i \cdot R(k-i),\ k > n, \tag{1}$$

where $a_i$ are the LPC coefficients. If a signal is passed through a filter h(j), then the correlation coefficients $R_y(k)$ of the filtered signal y(j) are given by:

$$R_y(k)=R(k)*h(k)*h(-k), \tag{2}$$

where * is a convolution operator. In sub-band speech codecs, the filters are usually symmetric and are of finite length ("FIR"), and the lengths L of these filters are constrained by the codec delay requirements. With the symmetric assumption, the above equation can now be written as:

$$R_y(k)=R(k)*h(k)*h(k). \tag{3}$$

If h(j) is symmetric and has length L, then h(j)*h(j) is also symmetric and has length 2 L−1. To estimate the correlation coefficient $R_y(k)$ for larger values of k, Equation (3) would be very complex. However, the LPC order $n_0$ of the filtered signal is typically smaller (≤n), and hence it is necessary to calculate $R_y(k)$ for $0 \le k \le n_0$. This can be achieved by limiting the R(k) calculation to $0 \le k \le n0+L-1$.

Figure 4:
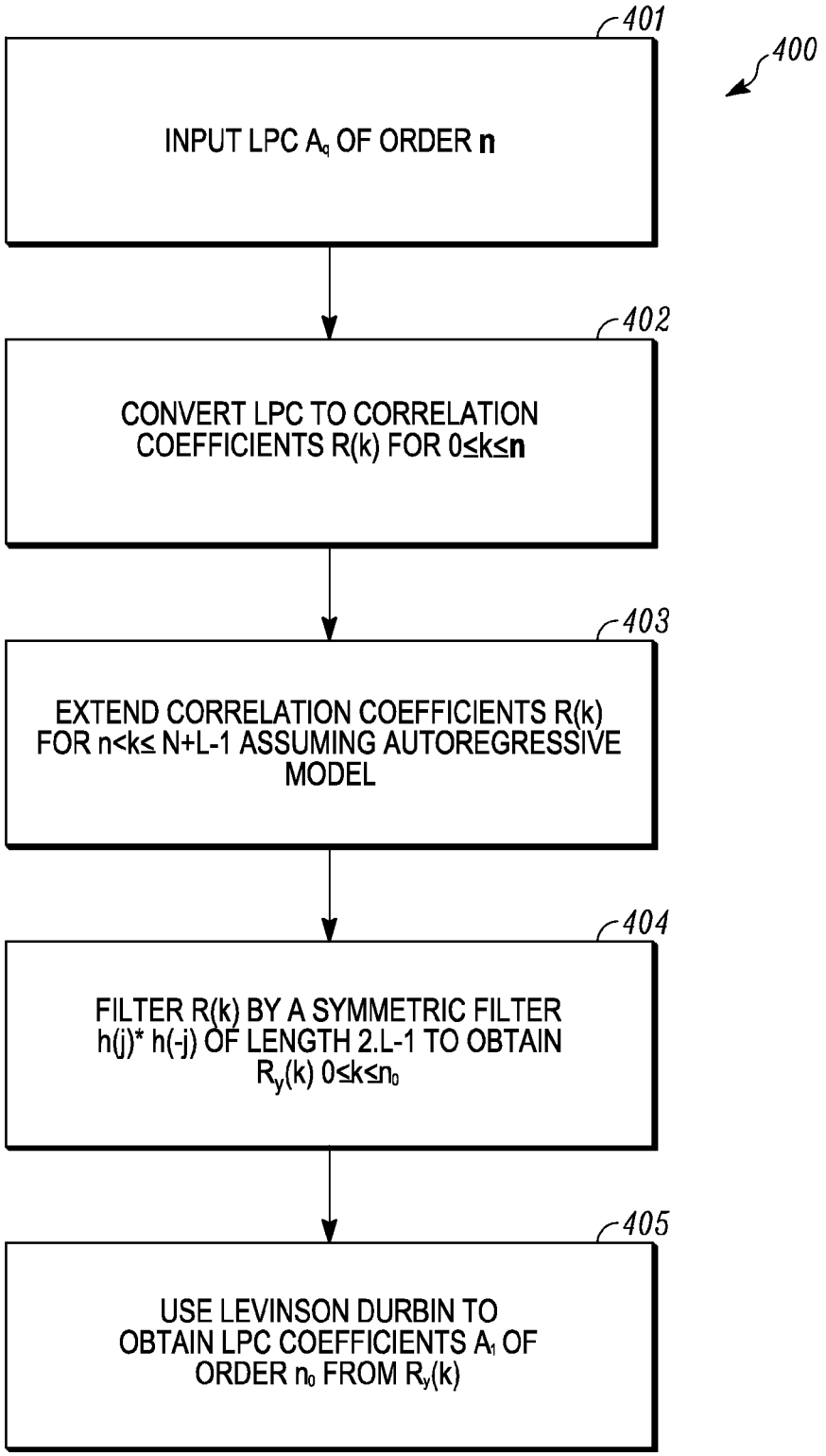
FIG. 4 is a flowchart illustrating an exemplary process for LPC coding in accordance with an embodiment of the disclosed principles.

A flow diagram for an exemplary LPC conversion process 400 is shown in FIG. 4. At stage 401 of the process 400, the LPC coefficients $A_q$ of order n are received. Subsequently at stage 402, the LPC coefficients $A_q$ are converted to correlation coefficients $R_y(k)$ for $0 \le k \le n$. As will be appreciated, stage 402 of the process 400 utilizes an inverse correlation equation:

$$R(k) = \sum_{i=1}^{n} a_i \cdot R(i-k)\ 1 \le k \le n. \tag{4}$$

At stage 403 of the process 400, the correlation coefficients $R_y(k)$ for $n \le k \le L+n-1$ are extended via autoregression, using equation (1) above, for example. At stage 404 of the process, the R(k) are filtered, using equation (2) above, for example. Finally at stage 405, Levinson Durbin is used to obtain LPC coefficients $A_l$ of order $n_0$ from $R_y(k)$.

It will be appreciated that with R(0)=1, and the LPC coefficients $a_i$ known, the above equation can be viewed as a set of n simultaneous equation with R(1), R(2), . . . , R(n) unknowns. This set of equations is solvable with stable LPC coefficients. In order to avoid the high complexity (order $n^3$) of direct solutions such as Gaussian elimination, the equation in matrix form can be assumed to have a Toeplitz structure. In this way, the LPC coefficients are converted to reflection coefficients and thence to the correlation values. Both of these algorithms have a complexity of the order $n^2$, and hence the overall complexity of obtaining correlation coefficients from LPC is of order $n^2$.

Figure 5:
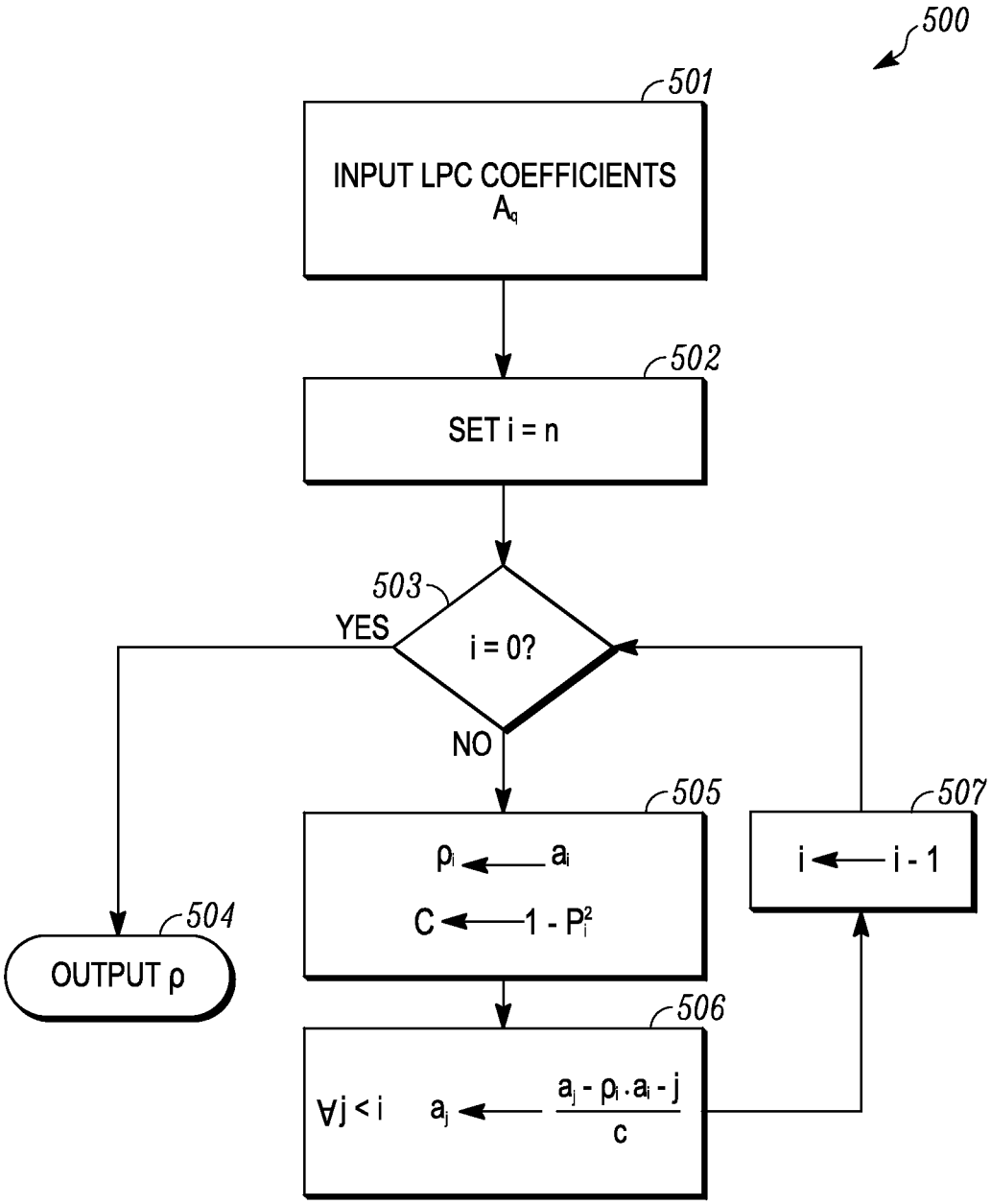
FIG. 5 is a flowchart illustrating an exemplary process for converting LPC coefficients to reflection coefficients in accordance with an embodiment of the disclosed principles.
Figure 6:
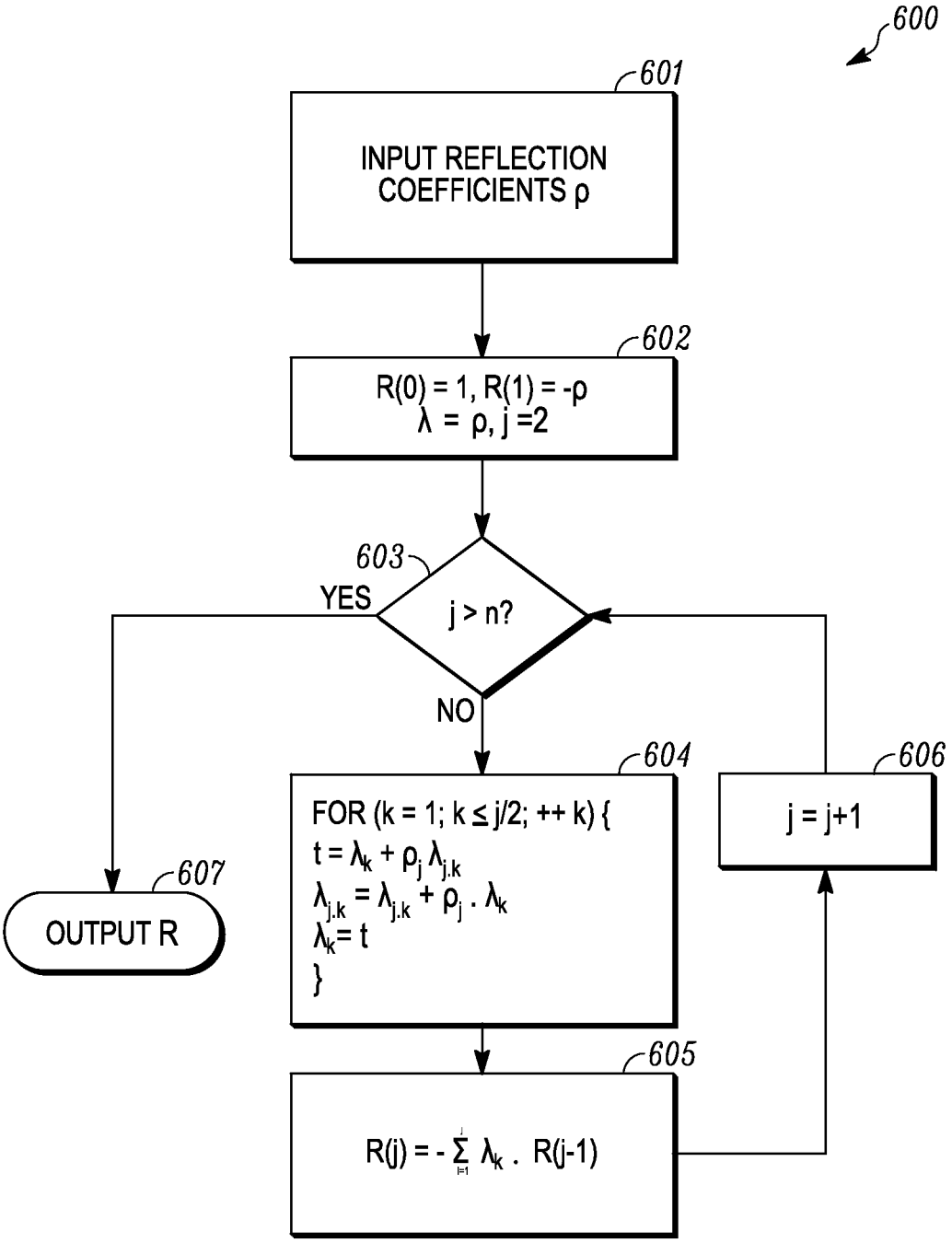
FIG. 6 is a flowchart illustrating an exemplary process for converting reflection coefficients to correlations in accordance with an embodiment of the disclosed principles.

Flow diagrams showing exemplary processes for converting LPC coefficients $a_i$ to reflection coefficients and converting reflection coefficients to correlations are shown in FIGS. 5 and 6 respectively. From these processes, it is seen that the complexity of the overall system is on the order of $n^2$. Turning specifically to FIG. 5, the process 500 for converting LPC coefficients to reflection coefficients begins at stage 501, wherein LPC coefficients $A_q$ are input. The value of i is set equal to n at stage 502. At stage 503, it is determined whether i=0, and if so, then the process 500 flows to stage 504, wherein output ρ is provided.

Otherwise the process 500 flows to stage 505, wherein $\rho_i \leftarrow a_i$ and $c \leftarrow 1-\rho_i^2$. From there the process 500 flows to stage 506, wherein ∀j<i, $$\rho_i \leftarrow \frac{a_j - \rho_i \cdot a_{i-j}}{c}.$$

At stage 507, the value of i is decremented, and the process flow returns to stage 503. Once i reaches 0, the process provides an output at stage 504 as discussed above.

Turning to FIG. 6, the illustrated process 600 is an example technique for converting reflection coefficients to correlations. At stage 601 of the process 600, the reflection coefficients ρ are received. At stage 602, the system values are set such that R(0)=1, $R(1)=-\rho_1$, λ=ρ and j=2. It is determined at stage 603 whether j>n, and if not, then the process 600 continues with stage 604, wherein:

$$\text{for}(k=1;k \le j/2;++k)\{t=\lambda_k+\rho_j \cdot \lambda_{j-k}\lambda_{j-k}=\lambda_{j-k}+\rho_j \cdot \lambda_k\lambda_k=t\}$$

At stage 605, R(j) is calculated according to $$R(j) = -\sum_{i=1}^{j} \lambda_l \cdot R(j-l),$$

and the value of j is incremented at stage 606 before the process 600 returns to stage 603. If j>n at stage 603, then the process 600 terminates at stage 607 and outputs the correlation values R. Otherwise, the foregoing steps are again executed until j>n.

As noted above, embodiments of the described autoregressive extension technique are generally superior to ordinary FFT techniques in terms of complexity and accuracy. For example, consider a full band input signal (having 8 kHz bandwidth) which is an order 16 AR process. Assume that the LPC analysis for n=16 (i.e., no mismatch between the actual order and the analysis order) is performed on the full band signal, and the full band signal is passed through an L=51 tap symmetric FIR low-pass filter to obtain a filtered signal. The normalized correlations ($n_0$=16) of the filtered signal can be obtained using the autocorrelation method, and the actual spectrum can be obtained from the correlations.

Figures 7, 7A:
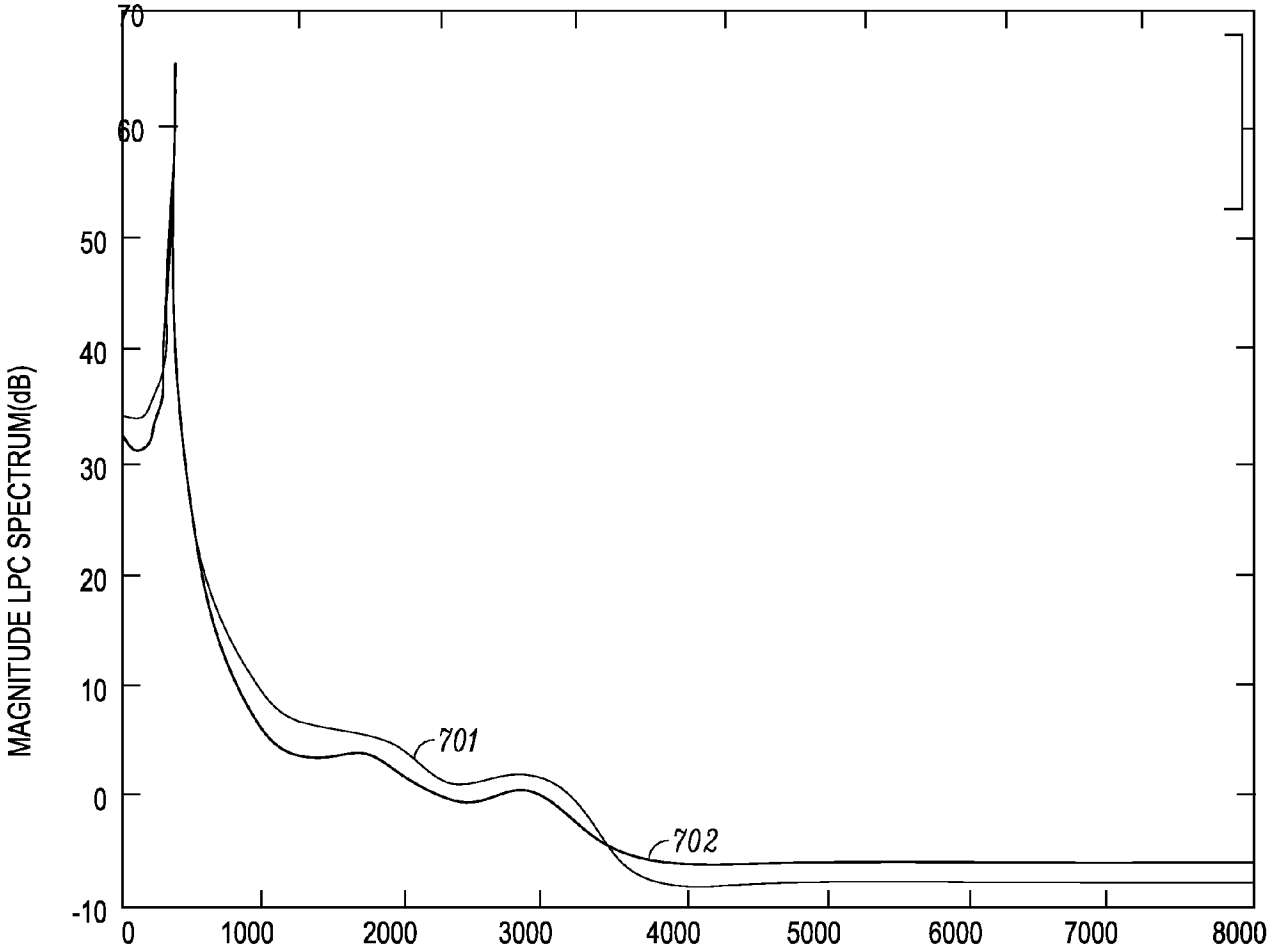
FIG. 7 is a pair of trace plots comparing performance of a codec in accordance with the disclosed principles to Fast Fourier Transform ("FFT") based codecs of varying lengths.
Figure 7B:
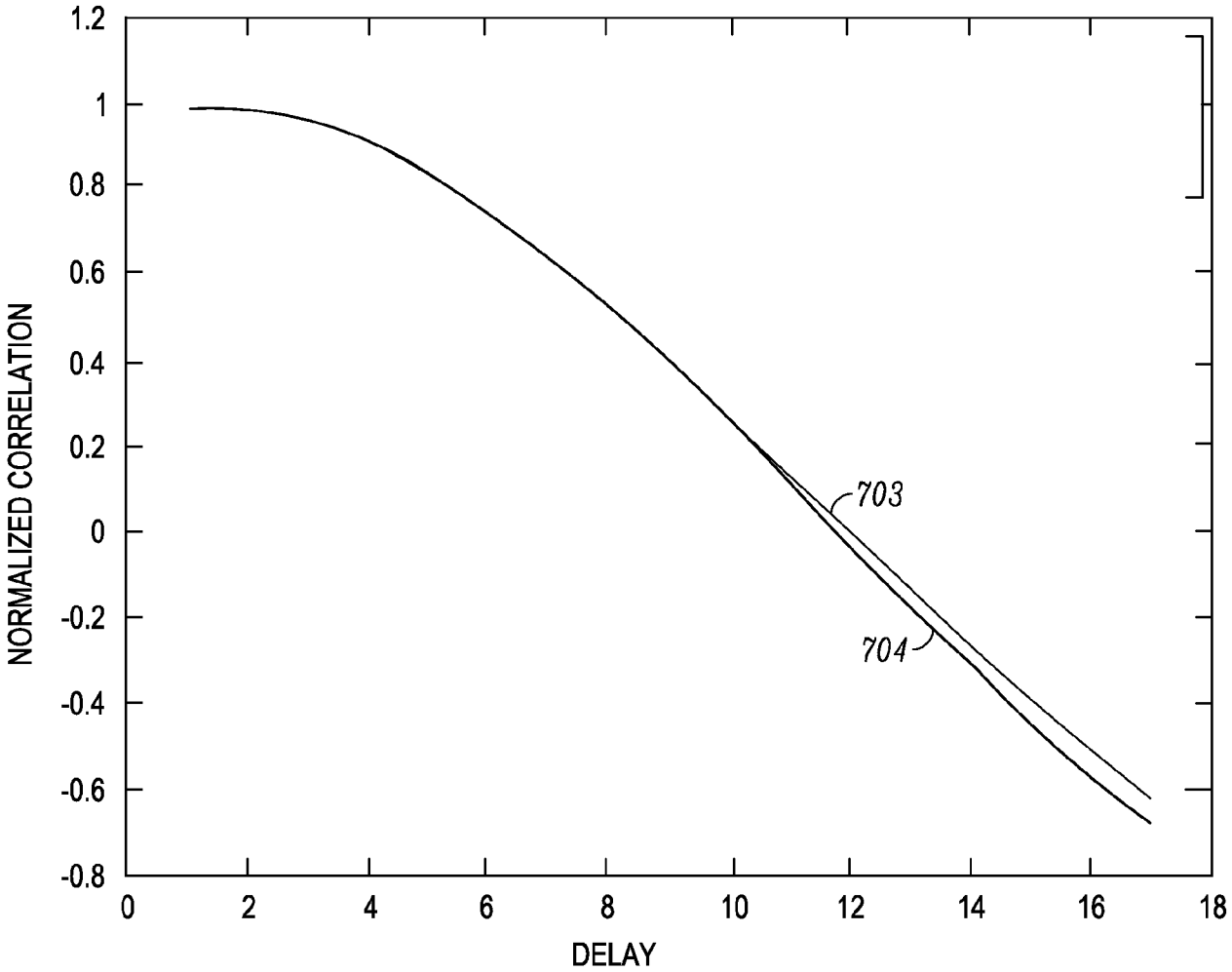

For purposes of comparison, spectra were obtained using the described LPC conversion method as well as two FFT-based LPC conversion methods (using FFT of lengths 256 and 1024). FIG. 7 shows traces of the two FFT-based conversions as well as the trace of the described LPC conversion method. In particular, the results of both the described LPC conversion method and the length 1024 FFT conversion method are reflected in traces 701 and 703 (which are generally overlapping), while the results of the length 256 FFT conversion method are reflected in traces 702 and 704. It can be seen that the described LPC conversion method performs similarly to the length 1024 FFT conversion method and much better than the length 256 FFT conversion method. Further, while the 1024 point FFT method does have comparable performance to the described LPC conversion method, the 1024 point FFT method entails much higher complexity, as seen above.

By way of summary, FIG. 7 compares the performance of the described LPC conversion method and FFT-based conversion methods when the full band signal was AR of order 16 and the LPC analysis order was also 16. Also, the high performance and low complexity of the described LPC conversion method extends to other contexts as well. For example, a comparison of the performance of the various LPC conversion schemes was made with a full band signal that was AR of order 18 where the LPC analysis order for the full band signal was n=16 (mismatch between the signal model order and the LPC analysis model order). In this context, the described LPC conversion method again performed as well as the 1024 point FFT method and better than the 256 point FFT method.

The process of LPC conversion described herein is also applicable when upsampling or downsampling are involved. In this situation, the upsampling and downsampling can be applied to the extended correlations.

In order to more generally compare the resource cost of the described algorithm to that of the FFT-based methods, consider the differences in computational complexity between certain example steps from the two approaches. In the described approach, the computational complexity of obtaining the correlations from the LPC is approximately equal to $2.5\cdot n\cdot(n+1)$ operations. The autoregressive extension of the correlations requires an additional $(L+n_0-n)\cdot n$ operations. Finally, filtering of the correlations requires $(2\cdot L-1)\cdot n_0$ operations. Thus the total number of simple (multiply and add) operations $C_1$ is:

$$C_1=2.5\cdot n\cdot(n+1)+(L+n_0-n)\cdot n+(2\cdot L-1)\cdot n_0.$$

So, given an example of L=50 and $n=n_0=16$, then the number of simple mathematical operations is $C_1=2984$. Additionally, there are n divide operations, which require more processing cycles than simple multiply and add operations. Assuming the computational complexity of a divide operation is 15 processing cycles, then the overall complexity of the described approach is approximately 2984+16·15=3224 operations.

Turning now to the complexity of the FFT approach, the complexity of real FFT or Inverse FFT is assumed to be 2·N log(N/2). The complexity of a divide is again assumed to be 15 times the complexity of multiply and add operations. The overall complexity $C_2$ is therefore given by:

$$C_2=4\cdot N\log(N/2)+7.5\cdot N.$$

Thus for N=256, $C_2$ is approximately 9000 operations. Thus, as can be seen, even for an FFT length of 256, the FFT-based approach is approximately three times as complex as the approach described herein.

In keeping with a further embodiment, the described principles are also applicable in the context of analysis-by-synthesis ("AbS") speech codecs (e.g., Code-Excited Linear Prediction ("CELP") codecs). In AbS speech codecs, an excitation vector is passed through an LPC synthesis filter to obtain the synthetic speech as described further above. At the encoder side, the optimum excitation vector is obtained by conducting a closed loop search where the squared distortion of an error vector between the input speech signal and the fed-back synthetic speech signal is minimized. For improved audio quality, the minimization is performed in the weighted speech domain, wherein the error signal is further processed through a weighting filter W(z) derived from the LPC synthesis filter.

Let 1/A(z) be the LPC synthesis filter, where:

$$A(z)=\sum_{i=0}^{n}a_i\cdot z^{-i},$$

and where n is the LPC order. The weighting filter is typically a pole-zero filter given by:

$$W(z)=\frac{A(z/\alpha_1)}{A(z/\alpha_2)},\ 0<\alpha_1<\alpha_2<1.$$

The synthesis and post-filtering steps of a CELP decoder provide another context within AbS speech codecs where filters are cascaded and where the process described herein may be used. Again, an LPC synthesis filter of the following form is used:

$$A(z)=\sum_{i=0}^{n}a_i\cdot z^{-i},$$

where n is the LPC order. This filter is then cascaded with a weighting filter W(z). In this case W(z) is of the form:

$$W(z)=\frac{A(z/\alpha_1)(1-\mu\cdot z^{-1})}{A(z/\alpha_2)},\ 0<\alpha_1<\alpha_2<1,$$

where $\mu<1$ is a tilt factor. Note that these synthesis and weighting filters may occupy the full bandwidth of the encoded speech signal or alternatively form just a sub-band of a broader bandwidth speech signal.

In both of these cases, the weighting filter may be written in the form:

$$W(z) = \frac{P(z)}{Q(z)},$$

where P(z) is an all zero filter of order L and 1/Q(z) is an all pole filter of order M. The weighted synthesis filter is now:

$$W_s(z) = \frac{1}{A(z)}\frac{P(z)}{Q(z)},$$

Passing the excitation vectors through the weighting synthesis filter is generally a complex operation. To reduce the complexity of the above operation, a method for approximating the weighted synthesis filter to an LP filter of order $n_0<n+M+L$ has been proposed in the past. However, such a method requires generating the approximate LP filter through the generation of the impulse response of the weighted synthesis filter and then obtaining the correlations from the impulse response. Similar to the FFT-based method, this method requires truncation and windowing of the impulse response and hence suffers from the same drawbacks as the FFT-based methods.

The problem of truncation can be resolved by using the autoregressive correlation extension approach described herein to approximate the LPC of a weighted synthesis filter. When only an all zero filter P(z) is used as a weighting filter, the weighted synthesis filter is given by:

$$W_s(z) = \frac{P(z)}{A(z)}.$$

In this situation, one can directly use the method of FIG. 4 to obtain an LPC approximation of $W_s(z)$ by using the filter coefficients of P(z) in place of h(j) and LPC synthesis filter A in place of $A_q$.

When an all pole filter 1/Q(z) is used as a weighting filter, the weighted synthesis filter is given by:

$$W_s(z) = \frac{1}{A(z)Q(z)}.$$

If one were to use the approach described in FIG. 4, then one would need to filter R(k) through an IIR filter 1/Q(z). Since R(k) is an infinite sequence and 1/Q(z) is an IIR filter, using the method shown in FIG. 4 will require truncation of the impulse response of 1/Q(z). This will result in a loss of precision. However, one can multiply the polynomials A(z) and Q(z) in the denominator of Ws(z) to obtain $B(z)=A(z)\cdot Q(z)$ which is a polynomial of order n+M. Thus, $Ws(z)=1/B(z)$ can be assumed to be an LPC synthesis filter of order n+M. However, for complexity reasons it is preferred that the approximate LPC filter order $n_0$ be less than n+M. For this, one can simply find the first $n_0$ reflection coefficients (e.g., via the method of FIG. 5) of B(z) and then obtain the approximate LPC filter using only those reflection coefficients.

When a pole-zero filter P(z)/Q(z) is used as a weighting filter, the weighted synthesis filter is given by:

$$W_s(z) = \frac{P(z)}{A(z)Q(z)}.$$

In this case, a combination of the two foregoing approaches may be applied. In particular, the polynomials A(z) and Q(z) in the denominator of $W_s(z)$ are multiplied to obtain $B(z)=A(z)\cdot Q(z)$, which is a polynomial of order n+M. $W_s(z)=1/B(z)$ is assumed to be an LPC synthesis filter of order n+M. At this point, the approach described in FIG. 3 may be applied by using B(z) in place of $A_q(z)$, n+M in place of n and the filter coefficients of P(z) in place of h(j).

A method of LPC conversion by filtering of the autoregressively extended correlation coefficients has been described. This method is in many embodiments an improvement over FFT-based methods in terms of both complexity and accuracy. However, in view of the many possible embodiments to which the principles of the present disclosure may be applied, it should be recognized that the embodiments described herein with respect to the drawing figures are meant to be illustrative only and should not be taken as limiting the scope of the claims. Therefore, the techniques as described herein contemplate all such embodiments as may come within the scope of the following claims and equivalents thereof.

We claim:

1. A method of encoding an audio signal, the method comprising:

receiving a set of linear predictive coefficients $a_i$ which are spectrally representative of a frame of the audio signal;

obtaining a set of correlations R(k) from the set of linear predictive coefficients based on $R(-k)=R(k)=\Sigma_{i=1}^{n}a_i\cdot R(k-i)$, where $0\leq k\leq n$;

extending the set of correlations using an autoregressive extension $R(-k)=R(k)=\Sigma_{i=1}^{n}a_i\cdot R(k-i)$, where k>n based on the linear predictive coefficients and on the set of correlations to obtain an extended set of correlations; and filtering the extended set of correlations by a finite impulse response filter to obtain a set of filtered extended correlations;

wherein n is an order of the autoregressive extension, k is an integer, and i is an integer.

2. The method of claim 1 further comprising:

obtaining a set of converted linear predictive coefficients based on the filtered extended correlations; and encoding the audio signal based on the set of converted linear predictive coefficients to obtain an encoding parameter for one of transmission and storage.

3. The method of claim 1 wherein the finite impulse response filter comprises a band pass filter.

4. The method of claim 1 wherein the finite impulse response filter is an all-zero portion of a weighting filter.

5. The method of claim 1 wherein the linear predictive coefficients are based on an all pole portion of a weighting filter.

6. The method of claim 1 wherein the finite impulse response filter is a symmetric filter.

7. The method of claim 1 further comprising employing Levinson-Durbin recursion to obtain linear predictive coefficients from the set of filtered extended correlations.

8. An encoder for encoding an audio signal, the encoder comprising:

a linear predictive coding ("LPC") coefficients analysis filter configured to receive a speech signal and to produce quantized LPC coefficients $a_i$;

a first sub-band filter configured to receive the speech signal and to produce a first sub-band filtered signal;

a second sub-band filter configured to receive the speech signal and to produce a second sub-band filtered signal;

a first LPC and correlation conversion module associated with the first sub-band filter and configured to receive the quantized LPC coefficients and to generate first band LPC coefficients;

a second LPC and correlation conversion module associated with the second sub-band filter and configured to receive the quantized LPC coefficients and to generate second band LPC coefficients;

a first sub-band encoder module configured to receive the first band LPC coefficients and the first sub-band filtered signal and to produce first band quantized LPC parameters; and a second sub-band encoder module configured to receive the second band LPC coefficients and the second sub-band filtered signal and to produce second band quantized LPC parameters;

wherein at least one of the first sub-band encoder module and the second sub-band encoder module is configured to produce sub-band quantized LPC parameters by converting the quantized LPC coefficients to a set of correlations R(k) where $R(-k)=R(k)=\Sigma_{i=1}^{n}a_i \cdot R(k-i)$, where $0 \le k \le n$ and extending the set of correlations using an autoregressive extension based on $$R(-k) = R(k) = \sum_{i=1}^{n} a_i \cdot R(k-i),\ k > n,$$

wherein n is an order of the autoregressive extension, k is an integer, and i is an integer.

9. The encoder of claim 8 wherein the first sub-band encoder module and the second sub-band encoder module are both configured to produce the respective first band and second band quantized LPC parameters by converting the quantized LPC coefficients to a set of correlations and extending the set of correlations using an autoregressive extension.

10. The encoder of claim 8 wherein the at least one of the first sub-band encoder module and the second sub-band encoder module is further configured to filter the extended set of correlations using a finite impulse response filter to obtain a set of filtered extended correlations.

11. The encoder of claim 10 wherein the finite impulse response filter comprises one of a band pass filter, an all-zero portion of a weighting filter, and a symmetric filter.

12. The encoder of claim 10 wherein the first band LPC coefficients and the second band LPC coefficients are spectrally representative of respective first and second sub-bands of a frame of the audio signal.

13. The encoder of claim 10 wherein each of the first sub-band encoder module and the second sub-band encoder module is further configured to employ Levinson-Durbin recursion to obtain LPC coefficients from the sets of filtered extended correlations.

14. A computing device having an audio-decoding function, the device comprising:

a coded speech input configured to receive full band quantized linear predictive coding ("LPC") coefficients $a_i$ of a frame of an audio signal as well as a first set of sub-band quantized parameters representative of a first sub-band of the frame of the audio signal;

a first sub-band LPC and correlation conversion module configured to receive the full band quantized LPC coefficients, to convert the full band quantized LPC coefficients to a set of correlations R(k) based on $R(-k)=R(k)=\Sigma_{i=1}^{n}a_i \cdot R(k-i)$, where $0 \le k \le n$, and to extend the set of correlations using an autoregressive extension based on $$R(-k) = R(k) = \sum_{i=1}^{n} a_i \cdot R(k-i),\ k > n,$$

where k>n, to generate first sub-band quantized LPC parameters; and a first sub-band decoder configured to receive the first sub-band quantized LPC parameters and the first set of sub-band quantized parameters to generate a first sub-band speech signal, wherein n is an order of the autoregressive extension, k is an integer, and i is an integer.

15. The computing device of claim 14 further comprising a first sub-band filter associated with the first sub-band decoder to filter the first sub-band speech signal yielding a first filtered sub-band speech signal.

16. The computing device of claim 14 wherein the first sub-band is one of a high frequency sub-band and a low-frequency sub-band.

17. The computing device of claim 14 wherein the first sub-band is a low-frequency sub-band.

18. The computing device of claim 17 wherein the coded speech input is further configured to receive a second set of sub-band quantized parameters spectrally representative of a second sub-band of the frame of the audio signal, and wherein the device further includes a second sub-band LPC and correlation conversion module configured to receive the full band quantized LPC coefficients, to convert the full band LPC coefficients to a set of correlations, and to extend the set of correlations using an autoregressive extension to generate second sub-band quantized LPC parameters and a second sub-band decoder configured to receive the second sub-band quantized LPC parameters and the full band quantized LPC coefficients to generate a second sub-band speech signal.

19. The computing device of claim 18 further including a combiner configured to combine the first sub-band speech signal and the second sub-band speech signal to yield a full band speech signal.

* * * * *